US008191499B2

(12) United States Patent
Furukawa et al.

(10) Patent No.: US 8,191,499 B2
(45) Date of Patent: Jun. 5, 2012

(54) LIQUID APPLICATION APPARATUS, IMAGE FORMING APPARATUS AND LIQUID APPLICATION METHOD

(75) Inventors: Koji Furukawa, Kanagawa-ken (JP); Yusuke Nakazawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 537 days.

(21) Appl. No.: 12/395,892

(22) Filed: Mar. 2, 2009

(65) Prior Publication Data

US 2009/0220701 A1 Sep. 3, 2009

(30) Foreign Application Priority Data

Mar. 3, 2008 (JP) ..... 2008-051821

(51) Int. Cl.
*B05C 1/06* (2006.01)
*B05C 1/08* (2006.01)
*B05C 5/00* (2006.01)

(52) U.S. Cl. ..... 118/258; 118/259; 118/261; 118/300; 118/304

(58) Field of Classification Search ..... 118/258–259, 118/261, 300, 304
See application file for complete search history.

(56) References Cited

U.S. PATENT DOCUMENTS 5,150,651 A * 9/1992 Flores ..... 101/207
6,789,878 B2 * 9/2004 Scheffelin et al. ..... 347/42
6,884,827 B2 * 4/2005 Ota et al. ..... 522/156
2006/0176325 A1 * 8/2006 Seki et al. ..... 347/7
2007/0070163 A1 * 3/2007 Masuyama et al. ..... 347/104

FOREIGN PATENT DOCUMENTS

JP 2007-83180 A 4/2007

* cited by examiner

*Primary Examiner* — Dah-Wei Yuan
*Assistant Examiner* — Stephen Kitt
(74) *Attorney, Agent, or Firm* — Birch, Stewart, Kolasch & Birch, LLP.

(57) ABSTRACT

The liquid application apparatus applies liquid to media of a plurality of types having different widths in a widthwise direction that is perpendicular to a direction of conveyance of the media. The liquid application apparatus includes: a liquid application member which has an application surface applying the liquid to the media; and a liquid holding member which has a plurality of recesses arranged in the widthwise direction, a plurality of liquid supply ports arranged respectively in the recesses, and a plurality of liquid discharge ports arranged respectively in the recesses, the liquid holding member forming a plurality of liquid chambers with the recesses by abutting against the application surface of the liquid application member. The liquid is supplied through the liquid supply ports and discharged through the liquid discharge ports, respectively and independently for the liquid chambers as selected in accordance with one of the widths of the media so that the liquid is applied only to a region that is inside a range of the one of the widths of the media, of the application surface of the liquid application member.

10 Claims, 16 Drawing Sheets

LIQUID APPLICATION APPARATUS, IMAGE FORMING APPARATUS AND LIQUID APPLICATION METHOD

BACKGROUND OF THE INVENTION

1. Field of the Invention

The present invention relates to a liquid application apparatus for applying liquid to a medium, and to an image forming apparatus and a liquid application method.

2. Description of the Related Art

Technology for applying liquid to a medium by means of a cylindrical application roller is known.

Japanese Patent Application Publication No. 2007-083180 discloses a composition including an application roller, which applies liquid to a medium, a back-up roller, which is disposed opposing the application roller, and a liquid holding member, which has a recess and abuts against the outer circumferential surface of the application roller and thereby forms a hermetically sealed liquid chamber (liquid holding space) with the outer circumferential surface of the application roller, the liquid being held in the liquid chamber.

According to the composition disclosed in Japanese Patent Application Publication No. 2007-083180, it is possible to simplify the structure that supplies the liquid to the application roller, but on the other hand, if the widths of the media (e.g., paper) onto which the liquid is applied vary, then the liquid deposited on the portion of the application roller where the paper does not pass is transferred to the back-up roller that forms the medium supporting member, and therefore the back-up roller becomes soiled, and moreover, since the liquid is transferred also to the rear surface of the medium against which the back-up roller is abutted, then the rear surface of the medium also becomes soiled.

SUMMARY OF THE INVENTION

The present invention has been contrived in view of these circumstances, an object thereof being to provide a liquid application apparatus, an image forming apparatus and a liquid application method, whereby it is possible to prevent soiling of the rear surface of the medium, or the like, caused by transfer of liquid, even if the widths of the media change.

In order to attain the aforementioned object, the present invention is directed to a liquid application apparatus which applies liquid to media of a plurality of types having different widths in a widthwise direction that is perpendicular to a direction of conveyance of the media, the apparatus comprising: a liquid application member which has an application surface applying the liquid to the media; and a liquid holding member which has a plurality of recesses arranged in the widthwise direction, a plurality of liquid supply ports arranged respectively in the recesses, and a plurality of liquid discharge ports arranged respectively in the recesses, the liquid holding member forming a plurality of liquid chambers with the recesses by abutting against the application surface of the liquid application member, wherein the liquid is supplied through the liquid supply ports and discharged through the liquid discharge ports, respectively and independently for the liquid chambers as selected in accordance with one of the widths of the media so that the liquid is applied only to a region that is inside a range of the one of the widths of the media, of the application surface of the liquid application member.

According to this aspect of the present invention, in an environment where the media of the plurality of types having different widths, it is possible to apply the liquid only to a region of the application surface of the liquid application member in the range of the width of the medium, by performing the supply of the liquid from the liquid supply ports and the discharge of the liquid from the liquid discharge ports respectively and independently for the liquid chambers as selected in accordance with the width of the medium, and hence it is possible to prevent soiling of the medium supporting member, which supports the medium and opposes the liquid application member, or of the rear surface of the medium itself, which abuts against this medium supporting member.

Preferably, the recesses of the liquid holding member are defined by partitions arranged according to differentials in the widths between the media with reference to a conveyance reference position which forms a reference in the widthwise direction when the media are conveyed to the liquid application member.

According to this aspect of the present invention, since the number of division of the recesses and hence the number of components required for the supply and discharge of the liquid is reduced in comparison with a case where a plurality of recesses of a uniform size are provided on the surface of the liquid holding member, then it is possible to suppress increase in apparatus related costs.

Preferably, the partitions are arranged according to the differentials in the widths between the media of at least one of A series sizes, B series sizes, an L size and a postcard size.

Preferably, the conveyance reference position includes a right-hand reference position and a left-hand reference position, and the partitions are arranged with reference to at least one of the right-hand reference position and the left-hand reference position.

According to this aspect of the present invention, since the number of division of the recesses and hence the number of components required for the supply and discharge of the liquid is reduced in comparison with a case where the recesses are obtained by division performed with reference to the center of the medium, then it is possible to suppress increase in apparatus related costs.

Preferably, the partitions are arranged for A series sizes with reference to one of the right-hand reference position and the left-hand reference position, and for B series sizes with reference to the other of the right-hand reference position and the left-hand reference position.

According to this aspect of the present invention, in an environment where the media of A series sizes (for example, A4) and B series sizes (for example, B4) are used as desired, the number of divisions of the recesses is minimized and the number of components is minimized, and therefore it is possible to minimize increase in apparatus related costs.

Preferably, the liquid application apparatus further comprises: a medium size determination device which determines the widths of the media; a liquid chamber selection device which selects a first group and a second group from the liquid chambers, the first group and the second group being located respectively inside and outside the range of the one of the widths of the media with reference to a conveyance reference position which forms a reference in the widthwise direction when the media are conveyed to the liquid application member, the first group and the second group being respectively to be and not to be supplied with the liquid; and a liquid supply and discharge device which supplies the liquid to the first group of the liquid chambers through the liquid supply ports, and discharges the liquid from the second group of the liquid chambers through the liquid discharge ports.

Preferably, the liquid holding member has an abutting portion which abuts against the liquid application member and is made of a low friction material which has a low frictional load with respect to the liquid application member.

According to this aspect of the present invention, friction between the liquid holding member and the liquid application member is reduced and the wear of the liquid holding member and the liquid application member can be reduced.

Preferably, the low friction material is fluororesin.

Alternatively, it is also preferable that the low friction material is one of polytetrafluoroethylene and polyoxymethylene.

In order to attain the aforementioned object, the present invention is also directed to an image forming apparatus, comprising: the above-described liquid application apparatus, wherein an image is formed on the medium by applying a liquid containing coloring material to the medium onto which the liquid has been applied by the liquid application member.

In order to attain the aforementioned object, the present invention is also directed to a liquid application method of applying liquid to media of a plurality of types having different widths in a widthwise direction that is perpendicular to a direction of conveyance of the media, by using: a liquid application member which has an application surface applying the liquid to the media; and a liquid holding member which has a plurality of recesses arranged in the widthwise direction, a plurality of liquid supply ports arranged respectively in the recesses, and a plurality of liquid discharge ports arranged respectively in the recesses, the liquid holding member forming a plurality of liquid chambers with the recesses by abutting against the application surface of the liquid application member, the method comprising the steps of: supplying the liquid through the liquid supply ports and discharging the liquid through the liquid discharge ports, respectively and independently for the liquid chambers in accordance with one of the widths of the media; and applying the liquid only to a region that is inside a range of the one of the widths of the media, of the application surface of the liquid application member.

Preferably, the liquid application method further comprises the steps of: determining the one of the widths of the media; selecting a first group and a second group from the liquid chambers, the first group and the second group being located respectively inside and outside the range of the one of the widths of the media with reference to a conveyance reference position which forms a reference in the widthwise direction when the media are conveyed to the liquid application member, the first group and the second group being respectively to be and not to be supplied with the liquid; and supplying the liquid to the first group of the liquid chambers through the liquid supply ports, and discharging the liquid from the second group of the liquid chambers through the liquid discharge ports.

According to the present invention, even in a case where the widths of the media change, it is still possible to prevent soiling of the rear surfaces of the media, or the like, due to the transfer of liquid.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
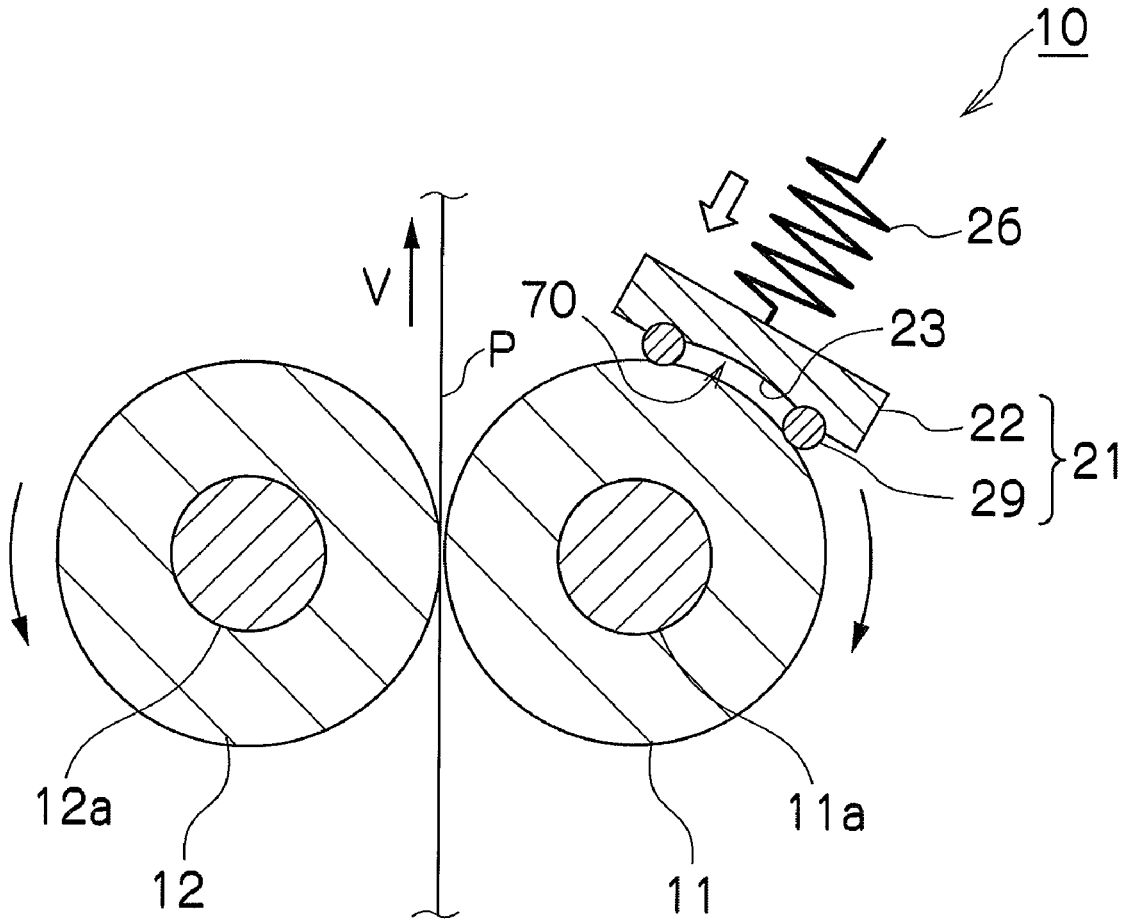
FIG. 1 is a cross-sectional drawing showing the principal part of a liquid application apparatus according to an embodiment of the present invention.

FIG. 1 is a cross-sectional drawing showing the principal part of a liquid application apparatus according to an embodiment of the present invention.

In FIG. 1, the liquid application apparatus 10 includes: an application roller 11, which serves as a liquid application member that applies liquid to a medium P being an object of application, a back-up roller 12, which is disposed so as to oppose the application roller 11, and a liquid holding member 21, which holds the application liquid between itself and the outer circumferential surface of the application roller 11. The outer circumferential surface of the application roller 11 forms an application surface that applies the application liquid to the medium P.

The application roller 11 and the back-up roller 12 are respectively supported rotatably by rotating shafts 11*a* and 12*a*, which are arranged in the axial direction perpendicular to the conveyance direction V of the medium P. The back-up roller 12 is impelled toward the outer circumferential surface of the application roller 11 by an impelling device (not shown). By means of the application roller 11 rotating in the clockwise direction in FIG. 1, the medium P is conveyed in the conveyance direction V.

The liquid holding member 21 according to the present embodiment extends over substantially the whole width of the application roller 11 in the axial direction (the length in the lengthwise direction), and is able to supply the application liquid to substantially the whole region of the outer circumferential surface of the application roller 11.

The liquid holding member 21 is constituted of a base member 22, and a loop-shaped abutting part 29, which projects from the surface of the base member 22 opposing the application roller 11 and abuts against the outer circumferential surface of the application roller 11. Thus, the liquid holding member 21 has recesses 23.

The liquid holding member 21 is impelled against the outer circumferential surface of the application roller 11 by the impelling force of an impelling member 26, such as a spring member. Consequently, the abutting part 29 of the liquid holding member 21 abuts against the outer circumferential surface of the application roller 11. In this abutting state, a plurality of hermetically sealed liquid chambers 70 (also referred to as "liquid holding spaces") are formed by the outer circumferential surface of the application roller 11 and the plurality of recesses 23 in the liquid holding member 21.

The structure of the liquid holding member 21 in FIG. 1 is described in detail with reference to FIGS. 2 to 8.

Figure 2:
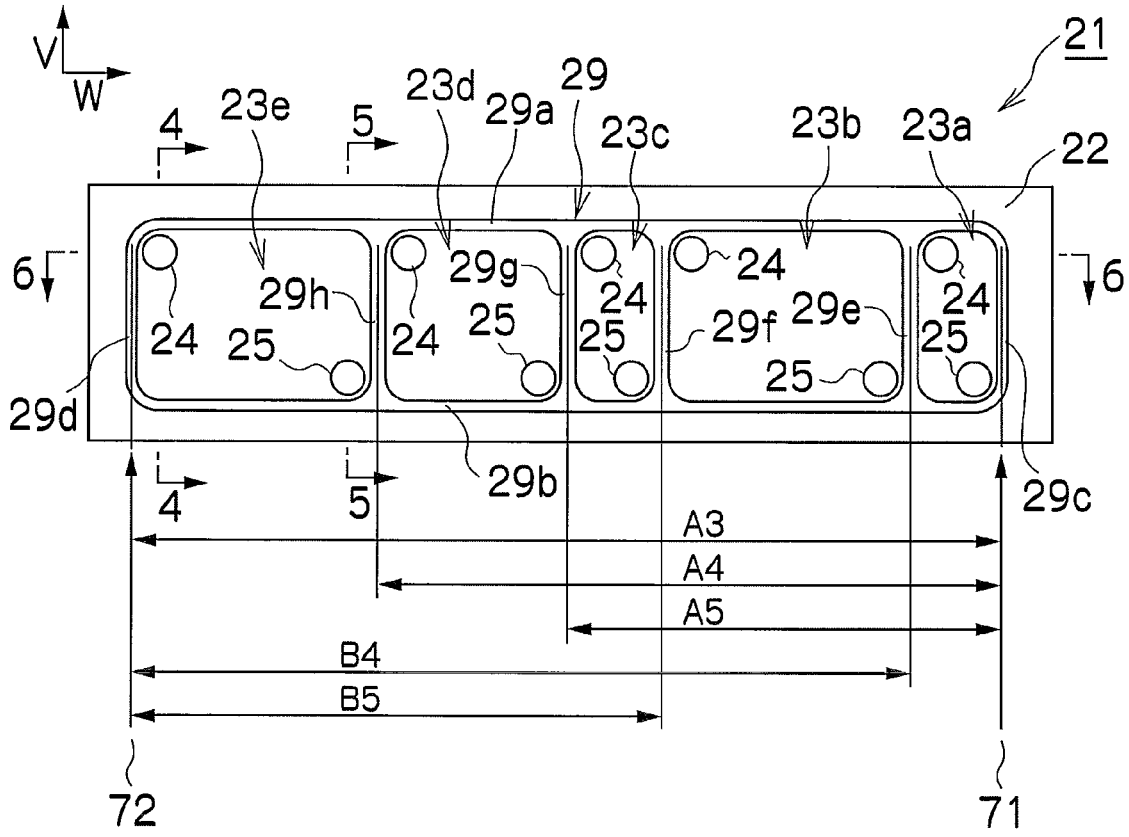
FIG. 2 is a front view diagram showing a liquid holding member.

FIG. 2 is a front view diagram showing the liquid holding member 21 in FIG. 1 as viewed from the side of the application roller 11 in FIG. 1.

In FIG. 2, the liquid holding member 21 has the plurality of recesses 23 (23*a* to 23*e*) arranged in the lengthwise direction of the liquid holding member 21, which is parallel with the widthwise direction W of the medium P perpendicular to the conveyance direction V of the medium P. The liquid holding member 21 also has pairs of liquid supply ports 24 and liquid discharge ports 25, which pairs are arranged respectively in the recesses 23. The recesses 23 are defined by the abutting part 29, which is fixed to the base member 22, and the portions of the base member 22 that are surrounded by the abutting part 29 (29*a* to 29*h*).

The abutting part 29 is formed of an elastic material and has a shape having vertical symmetry including an upper edge 29*a*, a lower edge 29*b*, a right-hand side edge 29*c*, a left-hand side edge 29*d* and partitions 29*e* to 29*h*, which separate the respective recesses 23. The abutting part 29 is fixed to the base member 22. Thus, the whole area including the recesses 23*a* to 23*e*, which is surrounded by the edges 29*a*, 29*b*, 29*c* and 29*d* of the abutting part 29, is divided up by the partitions 29*e*, 29*f*, 29*g* and 29*h*, thereby defining the respective recesses 23*a* to 23*e*, which are arranged in the widthwise direction W.

The recesses 23 of the present embodiment have a structure where they are obtained by division in the widthwise direction W on the basis of both a right-hand reference position 71 and a left-hand reference position 72, which are conveyance reference positions for media P of different types that have different sizes in the widthwise direction W. In other words, the structure is adopted in which the liquid holding space formed between the liquid holding member 21 and the application roller 11 by means of the edges 29*a*, 29*b*, 29*c* and 29*d* of the abutting part 29 of the liquid holding member 21 abutting against the application roller 11, are divided into a plurality of liquid chambers in the widthwise direction W, on the basis of the conveyance reference positions 71 and 72.

In the present embodiment, the divided recesses 23 are defined by taking the right-hand reference position 71 to serve as the reference for A series papers (for example, A3 size (portrait), A4 size (portrait), or A5 size (portrait)), and taking the left-hand reference position 72 to serve as the reference for B series papers (for example, B4 size (portrait) or B5 size (portrait)). To give a simple explanation of the correspondences between the recesses 23 and the A series paper sizes in the present embodiment, taking the right-hand side reference position 71 as a starting point, the three consecutive recesses (23*a* to 23*c*) correspond to the breadth of an A5 size medium, the four consecutive recesses (23*a* to 23*d*) correspond to the breadth of an A4 size medium (which is equal to the length of an A5 size medium), and the five consecutive recesses (23*a* to 23*e*) correspond to the breadth of an A3 size medium (which is equal to the length of an A4 size medium). Moreover, to give a simple explanation of the correspondences between the recesses 23 and the B series paper sizes in the present embodiment, taking the left-hand side reference position 72 as a starting point, the three consecutive recesses (23*e*, 23*d* and 23*c*) correspond to the breadth of a B5 size medium, and the four consecutive recesses (23*e*, 23*d*, 23*c* and 23*b*) correspond to the breadth of a B4 size medium (which is equal to the length of a B5 size medium).

In this way, the recesses 23 of the liquid holding member 21 according to the present embodiment have the structure whereby they are divided by the partitions 29*e* to 29*h* according to the size differential in the widthwise direction W between the different types of media that have different sizes in the widthwise direction W, by taking as the reference the conveyance reference positions 71 and 72, which serve as the references in the widthwise direction W when a medium is conveyed so as to pass between the application roller 11 and the back-up roller 12.

In the description given below, the case of the A series sizes and the B series sizes are explained separately with reference to FIGS. 3A and 3B, respectively.

Figure 3A:
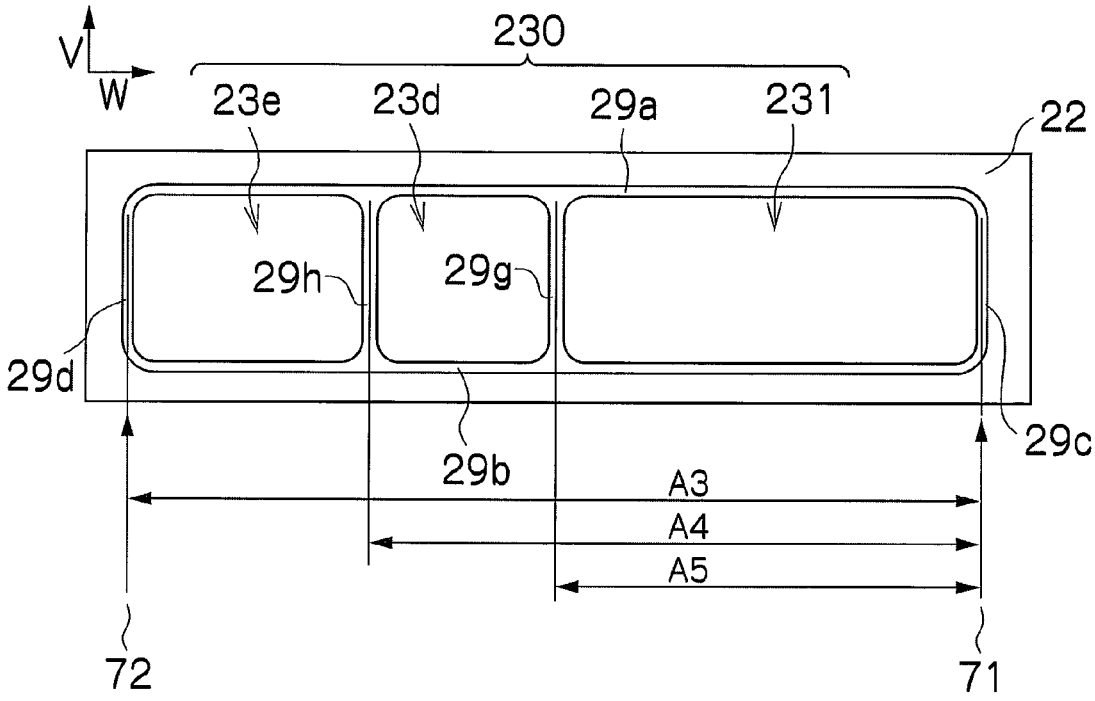
FIGS. 3A and 3B are illustrative diagrams used to describe the division of recesses of the liquid holding member.

FIG. 3A shows a case where the original recess 230 which is defined by the edges 29*a*, 29*b*, 29*c* and 29*d* of the abutting part 29 is divided with reference to the right-hand reference position 71 in respect of the A series sizes. The size of the widthwise direction W of the original recess 230 is equal to the width of the A3 portrait size, which is the largest widthwise size of the media that are the object of application. Taking the right-hand reference position 71 as the starting point, the divisions are made respectively and successively at the recess 231, which has the widthwise size equal to the width of the A5 portrait size, which is the smallest width in the A series, the recess 23*d*, which has a width equal to the differential between the widths of the A4 portrait size and the A5 portrait size, and the recess 23*e*, which has a width equal to the differential between the widths of the A3 portrait size and the A4 portrait size.

Figure 3B:
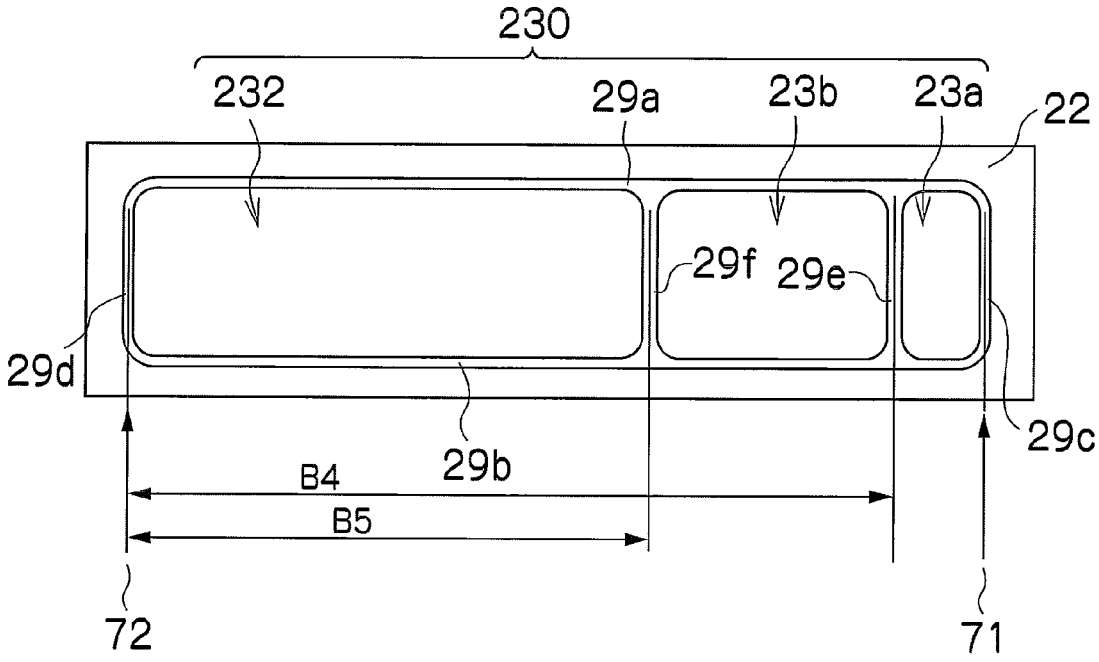

FIG. 3B shows a case where the original recess 230 is divided with reference to the left-hand reference position 72 in respect of the B series sizes. The size of the widthwise direction W of the original recess 230 is equal to the width of the A3 portrait size. Taking the left-hand reference position 72 as the starting point, the divisions are made respectively and successively at the recess 232, which has a width equal to the width of the B5 portrait size, which has the smallest width in the B series, and the recess 23*b*, which has a width equal to the differential between the widths of the B4 portrait size and the B5 portrait size.

The structure of the divisions of the recesses of the liquid holding member 21 shown in FIG. 2 combines the recess division structure shown in FIG. 3A and the recess division structure shown in FIG. 3B. In other words, the recesses 23 of the liquid holding member 21 according to the present embodiment have a structure in which the recesses are divided by the partitions 29*e* to 29*h* according to the differential in the widths between different media, by taking one of the right-hand reference position 71 and the left-hand reference position 72 as the reference for dividing the recesses 23 in respect of the A series sizes, and taking the other reference position as the reference for dividing the recesses 23 in respect of the B series sizes.

Each of the conveyance reference positions 71 and 72 according to the present embodiment is the position serving as the reference in the widthwise direction W of the medium P when the medium P is conveyed so as to pass between the application roller 11 and the back-up roller 12. For example, the right-hand reference position 71 is the position where the right-hand side of the medium P in the widthwise direction W abuts against a restricting member (not shown) on the conveyance path, and the left-hand reference position 72 is the position where the left-hand side of the medium P in the widthwise direction W abuts against another restricting member (not shown) on the conveyance path. In the embodiment shown in FIG. 2, media P having different sizes in the A series (A3 portrait size, A4 portrait size, A5 portrait size) are conveyed while abutting against the same right-hand reference position 71. On the other hand, media P having different sizes in the B series (B4 portrait size, B5 portrait size) are conveyed while abutting against the same left-hand reference position 72.

In the present embodiment, the conveyance reference positions 71 and 72 are also the starting points for dividing the recesses (the division reference positions). In other words, the structure is achieved whereby if one or some of the recesses 23 are selected by taking one of the conveyance reference positions as the starting point, then the liquid holding part having the overall width that corresponds to the width of the medium P is formed. Thus, the structure is adopted in which, by taking the conveyance reference position as the starting point and selecting one or some of the liquid chambers 70 from the plurality of liquid chambers 70, it is possible to supply the application liquid to the outer circumferential surface of the application roller 11 through the width corresponding to the width of the medium P.

In the following description, the conveyance reference positions may also be referred to simply as "reference positions".

The reference positions are set when designing the liquid application apparatus. For example, a conveyance path and control mechanism for conveying the medium P in accordance with the reference positions are provided. Furthermore, the side edge portions 29*c* and 29*d* of the abutting part 29 of the liquid holding member 21 are aligned in position with the reference positions.

Here, the recess division structure that corresponds to the A3 portrait size, the A4 portrait size and the A5 portrait size has been described; however, the structure is not limited in particular to this case. Furthermore, since the length of the A5 landscape size is the same as the breadth of the A4 portrait size, then it is also possible to join the recesses 23*b* and 23*c* into a common recess by restricting A5 sized media to being passed in a state where their lengthwise direction is parallel to the widthwise direction W.

Moreover, if B size media are not used, then as shown in FIG. 3A, it is possible to form the recesses corresponding to the A series sizes only.

Furthermore, although the description given here relates to the A series sizes and the B series sizes, there are no particular restrictions on the type of the medium P. For example, it is also possible to provide recesses 23 corresponding to the L sizes (sizes based on a reference size of 89 mm×127 mm) or the postcard size.

Figure 4:
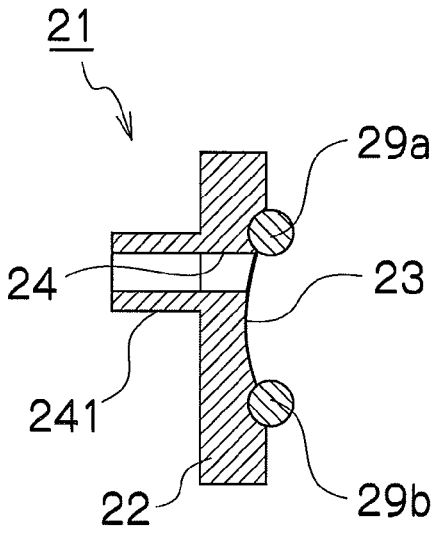
FIG. 4 is a cross-sectional diagram along line 4-4 in FIG. 2.
Figure 5:
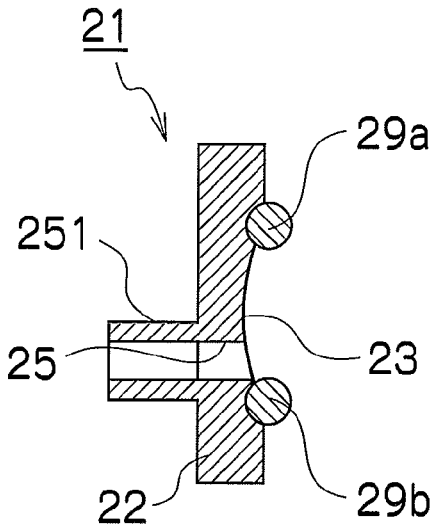
FIG. 5 is a cross-sectional diagram along line 5-5 in FIG. 2.
Figure 6:
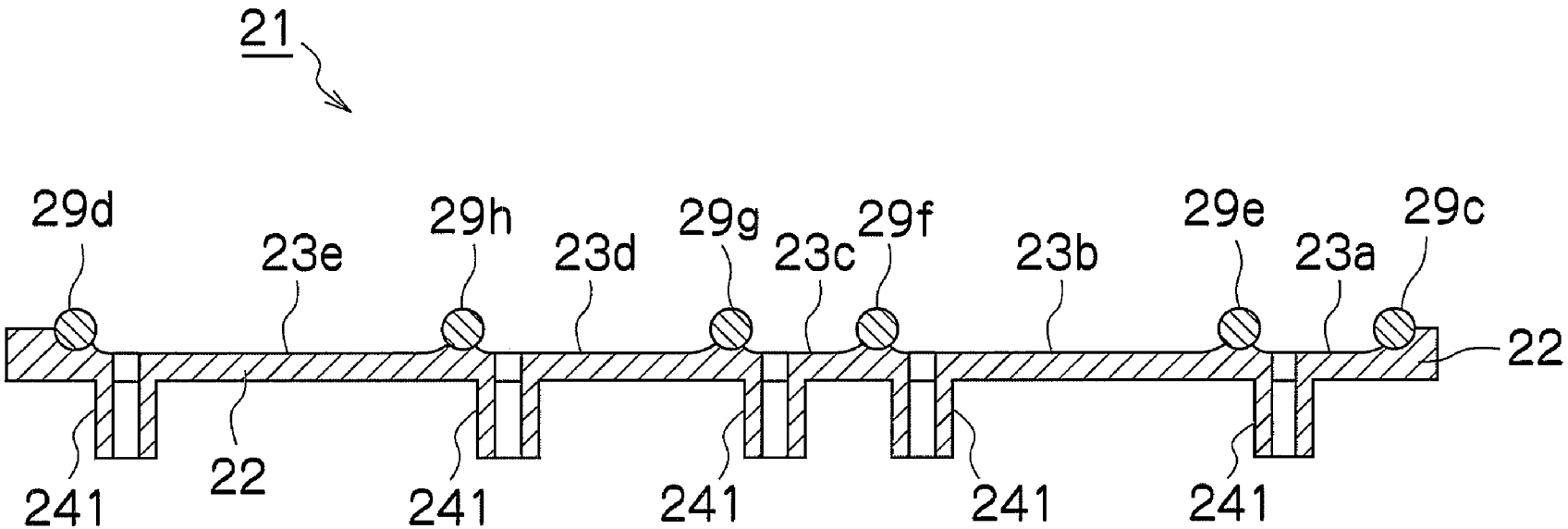
FIG. 6 is a cross-sectional diagram along line 6-6 in FIG. 2.
Figure 7:
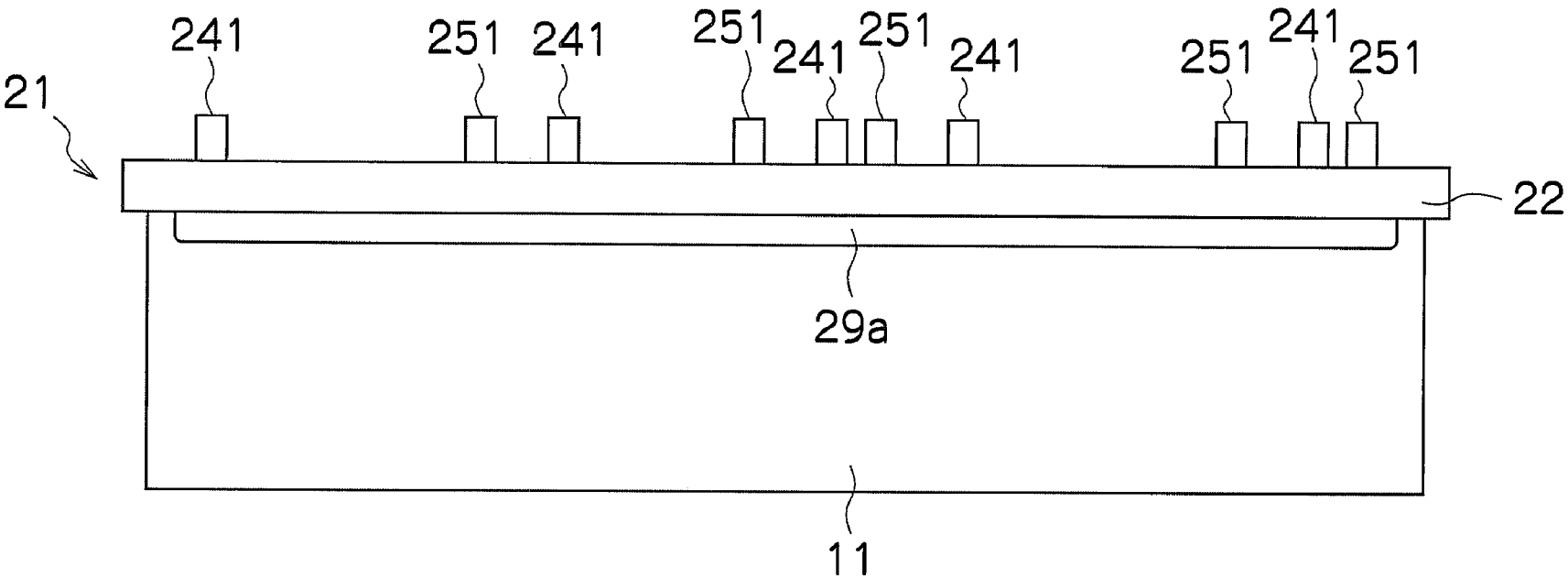
FIG. 7 is a plan diagram showing a state where the liquid holding member shown in FIG. 2 abuts against an application roller.
Figure 8:
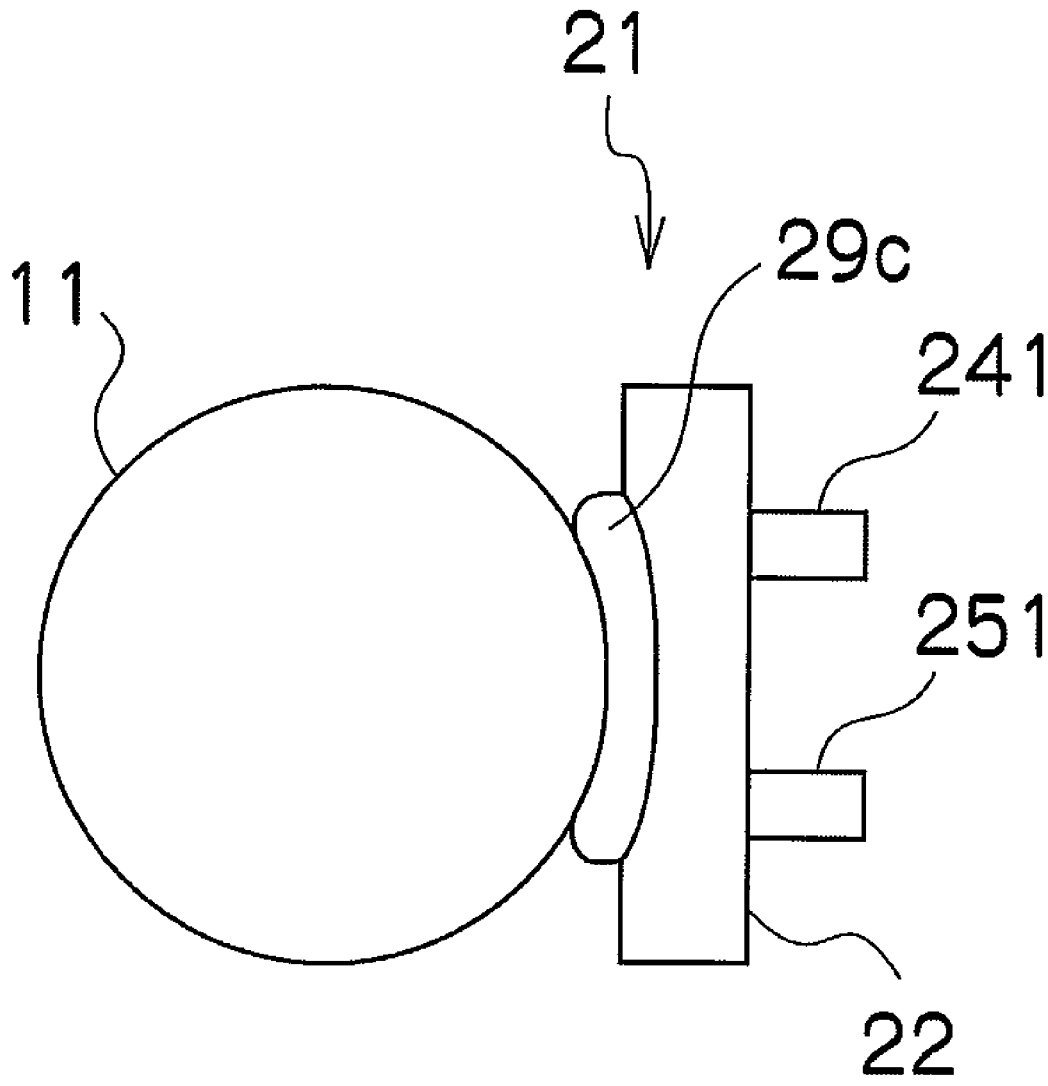
FIG. 8 is a side view diagram showing a state where the liquid holding member shown in FIG. 2 abuts against the application roller.

FIG. 4 is a cross-sectional diagram along line 4-4 in FIG. 2. FIG. 5 is a cross-sectional diagram along line 5-5 in FIG. 2. FIG. 6 is a cross-sectional diagram along line 6-6 in FIG. 2. Furthermore, the plan diagram of FIG. 7 and the right-hand side diagram of FIG. 8 show a state where the liquid holding member 21 in FIG. 2 is abutting against the application roller 11.

The recesses 23 of the liquid holding member 21 define a uniform interval between the base member 22 and the application roller 11.

In the liquid holding member 21 according to the present embodiment, the abutting part 29, which is formed in a unified fashion without joints, abuts in a continuous state without gaps against the outer circumferential surface of the application roller 11 due to the impelling force of the spring member 26 (shown in FIG. 1). As a result, the liquid chamber 70 (shown in FIG. 1) forms a space that is substantially sealed by the abutting part 29, the surface of the base member 22, on which the abutting part 29 is provided as a projection, and the outer circumferential surface of the application roller 11, and the liquid is held in this space.

In a state where the rotation of the application roller 11 has been halted, a hermetically sealed state (a state where the liquid does not pass between the interior and the exterior of the liquid chamber 70) is maintained between the abutting part 29 and the outer circumferential surface of the application roller 11. Here, in addition to a state where the abutting part 29 makes direct contact with the outer circumferential surface of the application roller 11, the hermetically sealed state also includes a state where the abutting part 29 indirectly abuts against the outer circumferential surface across a film of the liquid that is formed by capillary force.

Desirably, the partitions 29*e* to 29*h* of the abutting part 29 are formed to a width of 1 mm or less, in such a manner that the application liquid is present on the outer circumferential surface of the application roller 11 in a uniform fashion in the widthwise direction W. Since the application liquid spreads to some extent on the outer circumferential surface of the application roller 11, then the state of application of the liquid becomes uniform.

Furthermore, desirably, the side edges 29*c* and 29*d* of the abutting part 29 are formed in a curved shape in such a manner that they abut in a continuous fashion without gaps against the outer circumferential surface of the application roller 11 as shown in FIG. 8. Moreover, the cross-sectional shape of the portion of the base member 22 that is surrounded by the abutting part 29 (the cross-sectional shape of the base portion of the recesses 23) is desirably formed in a circular arc shape that follows the outer circumferential surface of the application roller 11, in such a manner that the liquid is applied to the outer circumferential surface of the application roller 11 in a uniform fashion in the direction of rotation of the application roller 11.

For the material of the abutting part 29 of the liquid holding member 21, a low friction material having a low frictional load with respect to the application surface of the application roller 11 is used. Examples of the low friction material include fluororesins such as polytetrafluoroethylene (PTFE), perfluoro alkoxyalkane (PFA), a perfluoroethylene propene copolymer (FEP), or the like. By using a low friction material of this kind, it is possible to reduce the friction between the liquid holding member 21 and the application roller 11 when the application roller 11 is operated and rotated, and hence the wear of the liquid holding member 21 and the application roller 11 can be reduced.

Furthermore, it is also possible to use polyoxymethylene (POM) as the material for the abutting part 29.

As shown in FIG. 2, liquid supply ports 24 and liquid discharge ports 25, which pass through the base member 22, are provided in the base member 22 of the liquid holding member 21 within the region surrounded by the abutting part 29. The liquid supply ports 24 and the liquid discharge ports 25 are respectively connected to cylindrical connecting sections 241 and 251, which project from the rear surface of the base member 22, as shown in FIGS. 4 to 6. The connecting sections 241 and 251 are connected to a liquid flow channel 30 described below with reference to FIG. 9. The liquid supply ports 24 supply the application liquid that is supplied from the liquid flow channel to the liquid chambers 70, and the liquid discharge ports 25 discharge the liquid inside the liquid chambers 70 to the liquid flow channel. By supplying and discharging the application liquid in this way, the application liquid flows from end to end inside each of the liquid chambers 70 in the present embodiment. The positions at which the liquid supply ports 24 and the liquid discharge ports 25 are arranged can be adjusted as appropriate in such a manner that a suitable flow of the application liquid is created.

Figure 9:
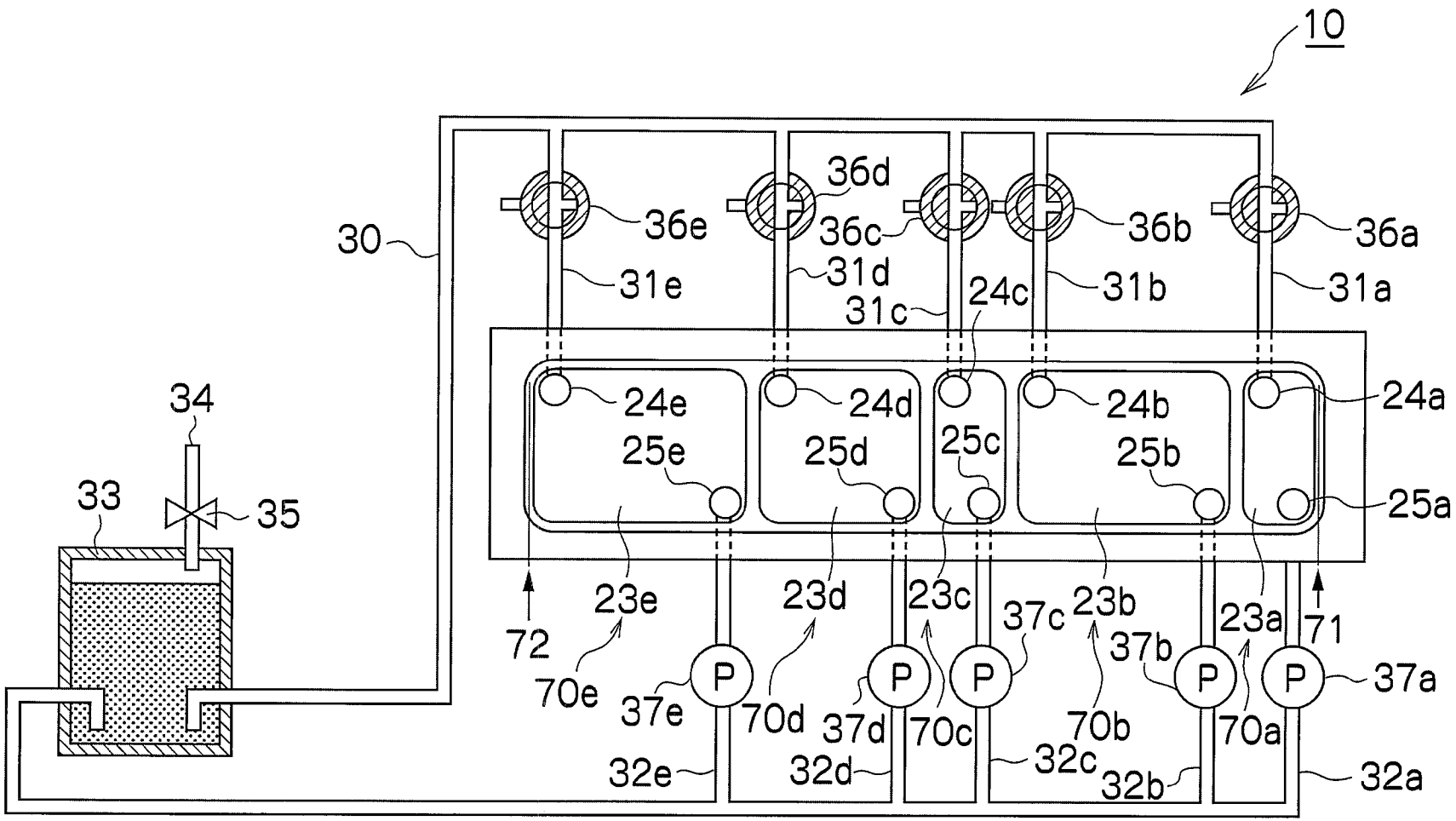
FIG. 9 is a schematic drawing showing a liquid supply system in the liquid application apparatus according to the embodiment of the present invention.

FIG. 9 is an illustrative diagram showing the composition of the liquid supply system in the liquid application apparatus 10 according to the present embodiment.

The liquid flow channel 30 includes liquid supply channels 31*a* to 31*e*, which connect a storage tank 33 storing the application liquid with the liquid supply ports 24*a* to 24*e* of the liquid holding member 21. The liquid flow channel 30 also includes liquid circulation channels 32*a* to 32*e*, which connect the liquid discharge ports 25*a* to 25*e* of the liquid holding member 21 with the storage tank 33.

The liquid supply channels 31*a* to 31*e* and the liquid circulation channels 32*a* to 32*e* are provided respectively for the recesses 23*a* to 23*e*. In other words, the liquid supply channels 31*a* to 31*e* and the liquid circulation channels 32*a* to 32*e* are provided respectively for the liquid chambers 70*a* to 70*e*, which are defined by the recesses 23*a* to 23*e* of the liquid holding member 21 and the application roller 11.

Switching valves 36*a* to 36*e* are three-way valves provided in the liquid supply channels 31*a* to 31*e* so as to correspond to the liquid chambers 70*a* to 70*e*. Each of the switching valves 36*a* to 36*e* switches between a state where the corresponding one of the liquid chambers 70*a* to 70*e* is connected to the atmosphere, and a state where the connection of the one of the liquid chambers to the atmosphere is shut off and the one of the liquid chambers is connected to the storage tank 33.

Pumps 37*a* to 37*e* are provided in the liquid circulation channels 32*a* to 32*e* so as to correspond to the liquid chambers 70*a* to 70*e*. The pumps 37*a* to 37*e* cause the application liquid and the air to flow in a desired direction through the liquid flow channel 30. In a state where the liquid chambers 70*a* to 70*e* are connected to the storage tank 33 by the switching valves 36*a* to 36*e*, the application liquid inside the application tank 33 is caused to flow to the liquid chambers 70*a* to 70*e* by the pumps 37*a* to 37*e*, respectively. In a state where the liquid chambers 70*a* to 70*e* are connected to the outside air by the switching valves 36*a* to 36*e*, air is caused to flow into the liquid chambers 70*a* to 70*e* by the pumps 37*a* to 37*e*, respectively. Moreover, the application liquid and air is caused to flow from the liquid flow channel 30 to the liquid chambers 70*a* to 70*e*, and the application liquid and air is caused to flow from the liquid chambers 70*a* to 70*e* to the storage tank 33, by the pumps 37*a* to 37*e*, respectively.

The storage tank 33 is provided with an air connection port 34, which has an air connection valve 35 switching between connecting to and shutting off air with respect to the storage tank 33.

By driving the pumps 37*a* to 37*e* while switching the switching valves 36*a* to 36*e* in accordance with the width of the medium P in a state where the air connection valve 35 is opened, the application liquid is supplied through the liquid supply port 24 to the liquid chambers 70 that are positioned inside the range of the width of the medium P, and furthermore the application liquid inside the liquid chambers 70 that are positioned outside the range of the width of the medium P is discharged through the liquid discharge port 25.

If the medium P has the A4 portrait size, for example, then the right-hand reference position 71 is taken as the reference and the four liquid chambers 70*a*, 70*b*, 70*c* and 70*d* are connected to the storage tank 33 through the switching valves 36*a*, 36*b*, 36*c* and 36*d*, which are respectively coupled thereto, and furthermore the other liquid chamber 70*e* is connected to the outside air through the switching valve 36*e*, which is coupled thereto. The pumps 70*a* to 70*e*, which are connected to the liquid chambers 70*a* to 70*e*, are driven. By this means, taking the right-hand reference position 71 as the reference, the application liquid is filled into the four liquid chambers 70*a*, 70*b*, 70*c* and 70*d* from the storage tank 33 through the liquid supply ports 24*a* to 24*d*, and the application liquid inside the other liquid chamber 70*e* is discharged from the liquid discharge port 25*e* and recycled to the storage tank 33, by the suctional force of the pump 37*e*.

Figure 10:
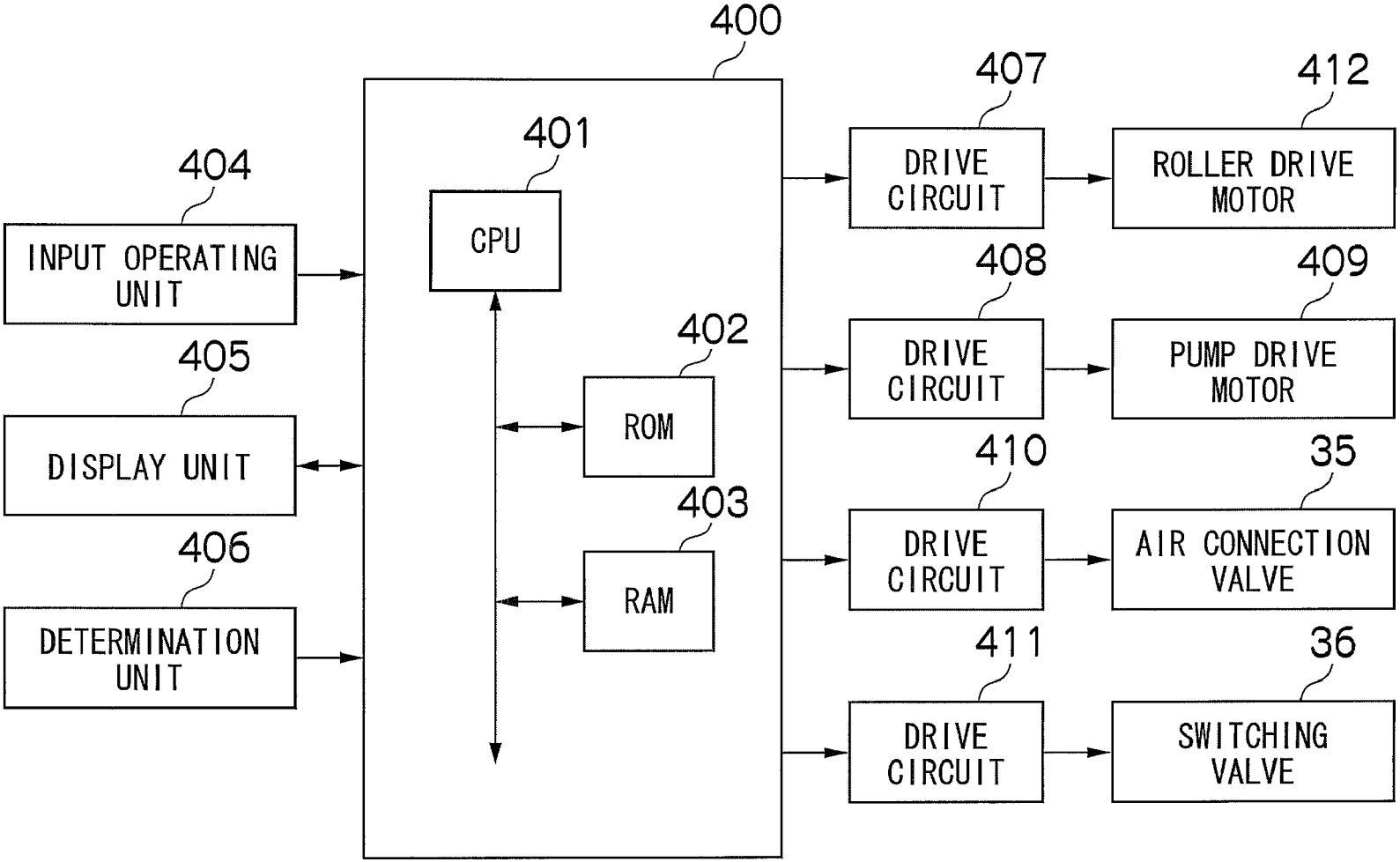
FIG. 10 is a schematic drawing showing a control system in the liquid application apparatus according to the embodiment of the present invention.

FIG. 10 is a block diagram showing the composition of a control system in the liquid application apparatus according to the present embodiment.

In FIG. 10, a control section 400 controls the whole of the liquid application apparatus. The control unit 400 includes: a CPU (Central Processing Unit) 401, which executes processing of various types in accordance with a prescribed program; a ROM (Read Only Memory) 402, which stores the program, and the like; and a RAM (Random Access Memory) 403, which temporarily stores data, and the like, that is used in the various types of processing.

An input operating unit 404 is constituted of a keyboard (or various switches, or the like) through which prescribed instructions or data are entered.

A display unit 405 performs various displays, and is constituted of a liquid crystal display, for example.

Moreover; a determination unit 406 is connected to the control unit 400. The determination unit 406 includes a medium size determination sensor for determining the width of the medium P (i.e., the size in the widthwise direction W, which is perpendicular to the conveyance direction V), a medium position determination sensor for determining the position of the medium P, and a sensor that determines the operational states of the respective units, and the like. Furthermore, a roller drive motor 412 driving rollers, a pump drive motor 409 driving the pumps 37, the air connection valves 35 and the switching valves 36 are connected respectively through drive circuits 407, 408, 410 and 411 to the control unit 400.

The control unit 400 selects the liquid chambers to which the liquid is to be supplied and the liquid chambers to which the liquid is not to be supplied, by controlling the switching valves 36 through the drive circuit 411 with reference to the conveyance reference position in the widthwise direction W. Further, the control unit 400 controls the pump drive motor 409 through the drive circuit 408 so that the liquid is supplied to and discharged from the liquid chambers 70 using the pumps 37.

In FIG. 10, a medium size determination device, which determines the size (width) in the widthwise direction W of the medium P, is constituted principally of the determination unit 406 and the control unit 400.

Figure 11:
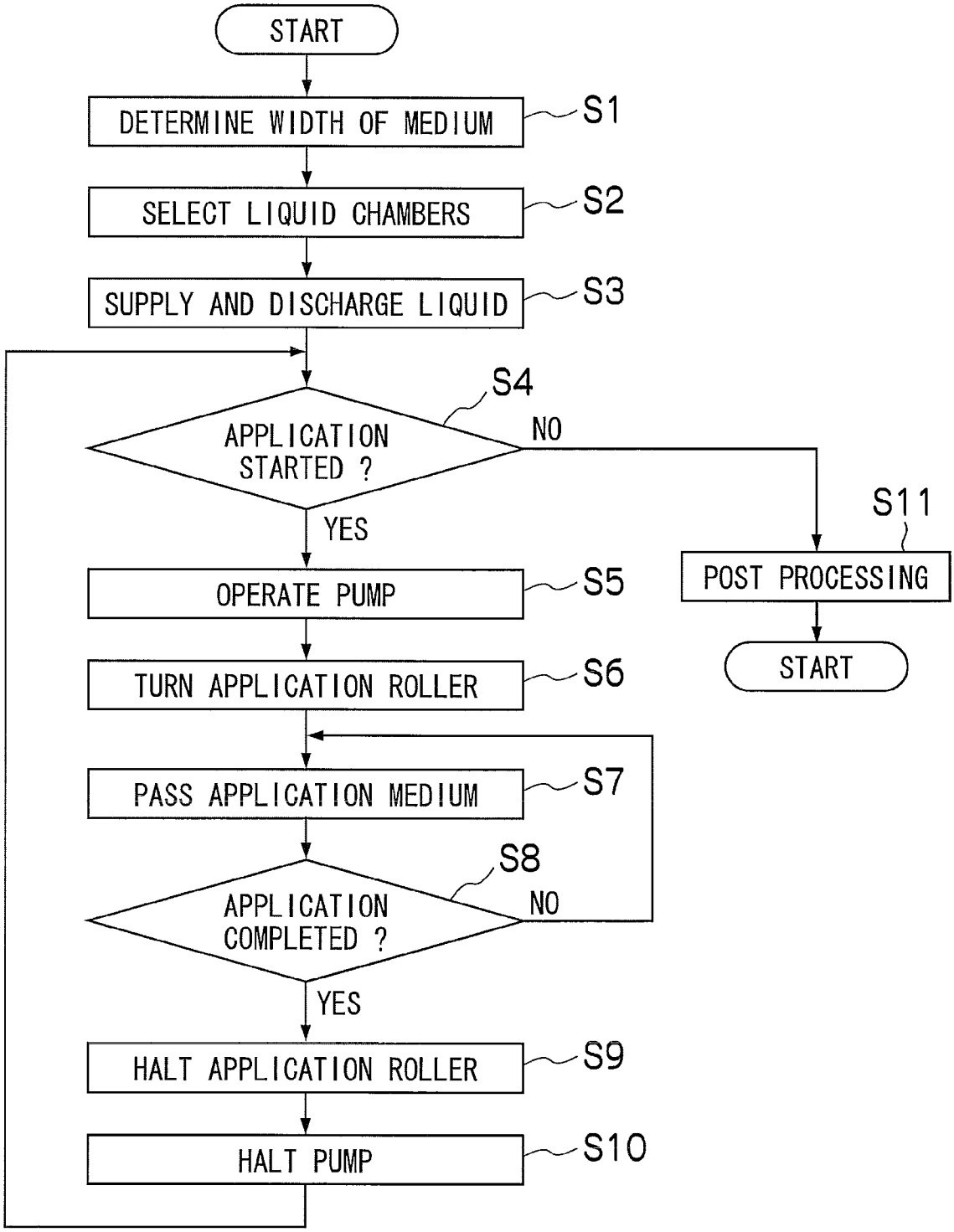
FIG. 11 is a flowchart showing the sequence of the liquid application processing in the liquid application apparatus according to the embodiment of the present invention.

FIG. 11 is a flowchart showing a sequence of the liquid application processing in the liquid application apparatus 10 according to the present embodiment. This processing is carried out in accordance with the program under the control of the CPU 401 in FIG. 10.

Firstly, at step S1, the width of the medium P is determined. For example, the determination unit 406 determines the type of medium P (namely, whether the medium is A3, A4, A5, B4 or B5), and the supply mode of the medium P (paper supplied in portrait mode or paper supplied in landscape mode). In the case of portrait paper supply, the breadth of the medium P is the size in the widthwise direction W, and in the case of landscape paper supply, the length of the medium P is the size in the widthwise direction W. The ROM 402 beforehand stores an information table that indicates the relationships between the combinations of media types and paper supply modes, and the widths of the media P in the widthwise direction W. The CPU 401 determines the width of the medium P in the widthwise direction W, on the basis of the determination results of the determination unit 406 and the table information in the ROM 402. It is also possible to determine the width of the medium P by using a sensor (for example, an optical sensor) that directly measures the width of the medium P in the widthwise direction W.

Next, at step S2, the storage tank 33 is opened to the outside air by opening the air connection valve 35, and the liquid chambers that are positioned inside the range of the width of the medium P, of the plurality of liquid chambers 70, are selected as the liquid chambers to which the liquid is to be supplied, while the liquid chambers positioned outside the range of the width of the medium P are selected as the liquid chambers to which the liquid is not to be supplied. In the present embodiment, the liquid chambers are selected by using the switching valves 36.

Figure 12:
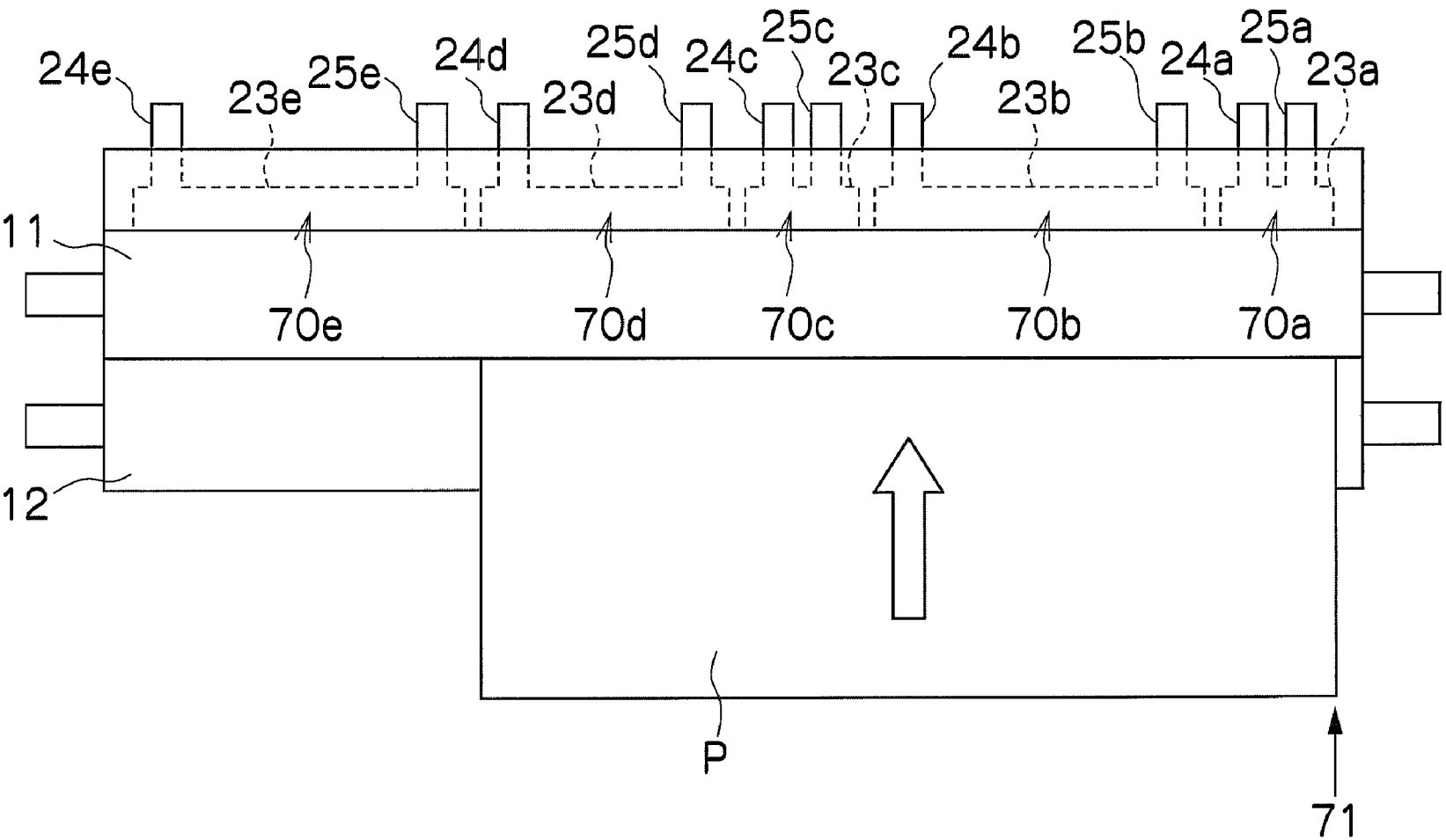
FIG. 12 is an illustrative diagram for describing medium conveyance and liquid application in the case of the right-hand reference position.

For example, as shown in FIG. 12, if the medium P (for example, an A4 portrait size medium) is conveyed by taking the right-hand reference position 71 as the reference point, then the liquid chambers are selected by taking the right-hand reference position 71 as the starting point, and the liquid chambers 70*a*, 70*b*, 70*c* and 70*d*, which correspond to the region through which the paper passes, are connected to the storage tank 33, whereas the liquid chamber 70*e*, which corresponds to the region through which the paper does not pass, is connected to the outside air.

Figure 13:
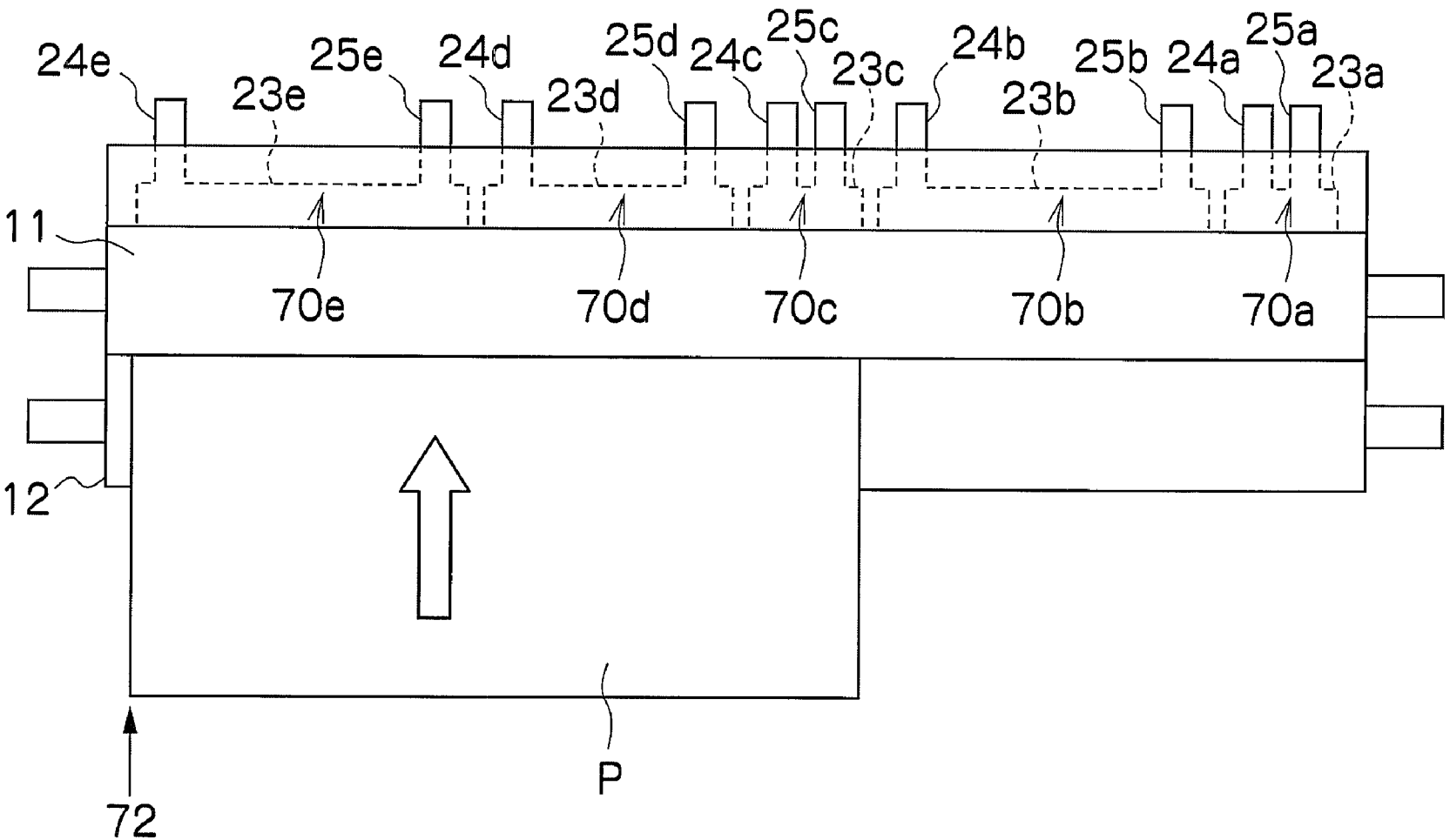
FIG. 13 is an illustrative diagram for describing medium conveyance and liquid application in the case of the left-hand reference position.

For example, as shown in FIG. 13, if the medium P (for example, a B5 portrait size medium) is conveyed by taking the left-hand reference position 72 as the reference point, then the liquid chambers are selected by taking the left-hand reference position 72 as the starting point, and the liquid chambers 70*e*, 70*d* and 70*c*, which correspond to the region through which the paper passes, are connected to the storage tank 33, whereas the liquid chambers 70*b* and 70*a*, which correspond to the region through which the paper does not pass, are connected to the outside air.

Next, at step S3, the pumps 37 are driven for a prescribed duration and the application liquid is supplied to the liquid chambers to which the liquid is to be supplied, of the plurality of liquid chambers 70, whereas residual application liquid is discharged from the liquid chambers to which the liquid is not to be supplied. More specifically, if the application liquid has not been filled into the liquid chambers 70 and the flow channels 31 and 32 that correspond to the region where the paper passes, then the air inside these is sent to the storage tank 33 by the pumps 37 and is discharged to the outside, and moreover the application liquid is filled into the liquid chambers 70 and the flow channels 31 and 32 that correspond to the region where the paper passes. Furthermore, if the application liquid has been filled in the respective sections already, then the application liquid of the respective sections is caused to flow in such a manner that the application liquid of suitable concentration and viscosity is supplied. On the other hand, if the application liquid has been filled in the liquid chambers 70 and the flow channels 31 and 32 that correspond to the region where the paper does not pass, then the application liquid inside these is returned to the storage tank 33 by means of the pumps 37. The application liquid remaining inside the liquid chambers 70 and the flow channels 31 and 32 that correspond to the region where the paper does not pass is returned to the storage tank 33 by means of the pumps 37. Through this initial operation, a state is achieved where the application liquid has been supplied to the paper passing region of the application roller 11, and thereby application of the liquid to the medium P becomes possible. On the other hand, the application liquid is not supplied to the region of the application roller 11 where the paper does not pass.

When an application start instruction is entered (step S4), the pumps 37 start operation again (step S5). Thus, the application liquid is circulated inside the liquid flow channels 30, in a state where the pressure at the liquid discharge port 25 is made lower than the pressure at the liquid supply port 24 in each of the liquid chambers 70 that correspond to the region where the paper passes. Thereupon, the application roller 11 starts to rotate in the clockwise direction in FIG. 1, while the application liquid is circulated inside the liquid flow channel 30 (step S6). By means of this rotation of the application roller 11, the application liquid filled in the liquid chambers 70 that correspond to the region where the paper passes flows out between the application roller 11 and the lower edge 29*b* of the abutting part 29, against the pressing force of the abutting part 29 of the liquid holding member 21 abutting against the application roller 11, and is applied in the state of a layer to the region of the outer circumferential surface of the application roller 11 where the paper passes. The application liquid applied to the application roller 11 is then conveyed to the abutting part between the application roller 11 and the back-up roller 12.

Figure 14:
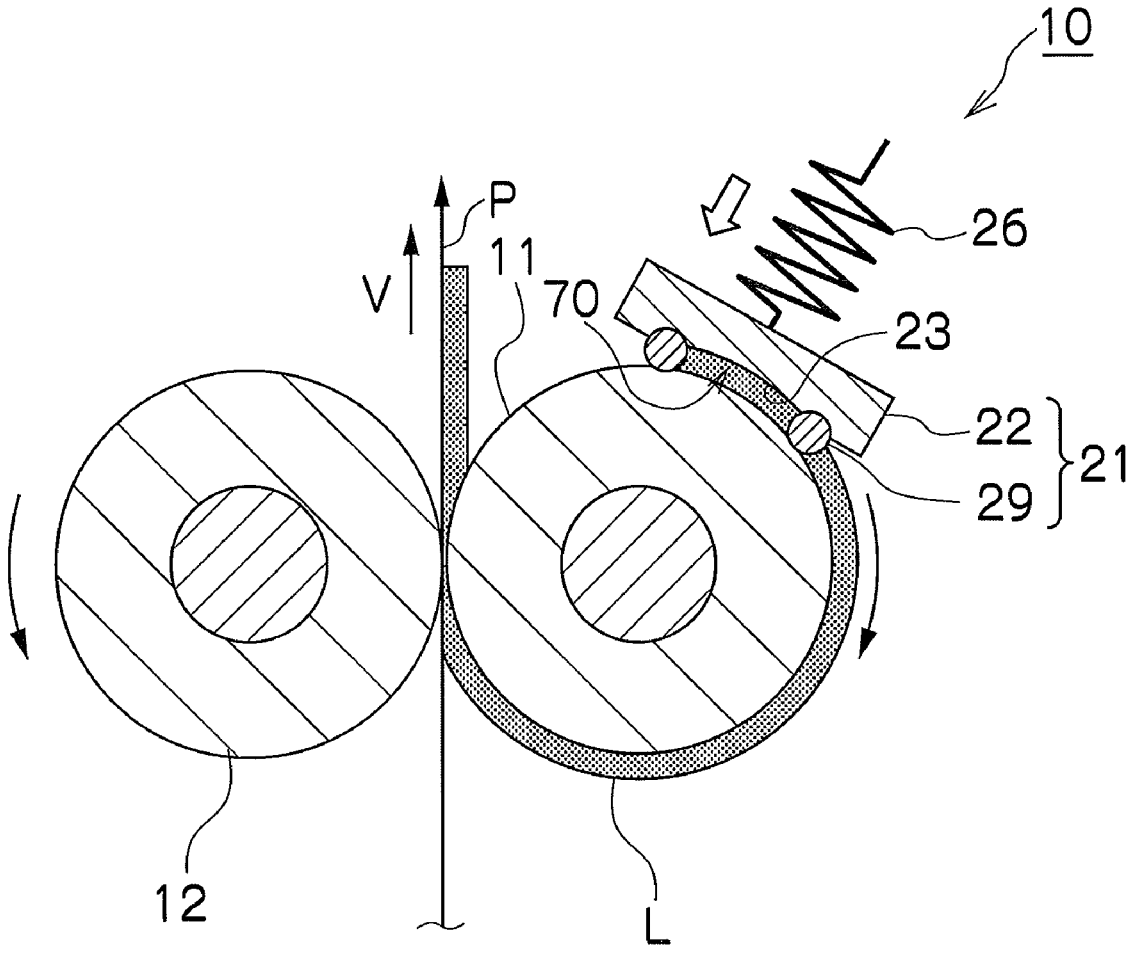
FIG. 14 is a vertical cross-sectional diagram for describing a state where the application liquid has been filled into the liquid chambers formed by the liquid holding member and the application roller, and where the application roller and the medium are in contact with each other.

Thereupon, the medium P is conveyed between the application roller 11 and the back-up roller 12, and the medium P is inserted between these rollers 11 and 12. Together with this, the inserted medium P is conveyed in accordance with the rotation of the application roller 11 and the back-up roller 12 (step S7). As shown in FIG. 14, during this conveyance, the application liquid L that has been applied to the outer circumferential surface of the application roller 11 is transferred from the application roller 11 to the medium P.

The device for supplying the medium P between the application roller 11 and the back-up roller 102 is of course not limited to a paper supply mechanism. For example, it is also possible to combine the use of a device based on manual feed using prescribed guide members in an auxiliary fashion, and it is also possible to use a manual feed device alone.

When the operation of the liquid application onto the medium P has been carried out as described above, it is then judged whether or not the application step has been completed (step S8), and if the application step has not been completed, then the procedure returns to step S7, and the application operation is repeated until the application step has been completed for the whole of the portion of the medium where the application is required. If the application step has been completed, then the application roller 11 is halted (step S9), and the driving of the pumps 37 is also halted (step S10). The procedure then returns to step S4, and if an application start instruction is entered, the operations in steps S5 to S10 described above are repeated. On the other hand, if an application start instruction is not entered, then post processing such as a recovery operation for recovering the application liquid inside the liquid chambers 70 and the liquid flow channels 30 is carried out (step S11), whereby the processing relating to the application is completed.

The above-described recovery operation is carried out by opening the air connection valve 35 and the switching valves 36, and driving the pumps 37 so as to cause the application liquid filled in the liquid chambers 70 and the liquid circulation channels 32 to flow into the storage tank 33. By carrying out this recovery operation, it is possible to reduce or completely prevent the evaporation of the application liquid from the liquid chambers 70. Furthermore, the storage tank 33 is shut off from the air after the recovery operation by closing the air connection valves 35 and switching the switching valves 36 to thereby shut off the connection with the liquid supply channels 31. Thus, it is possible to reduce or prevent the evaporation of application liquid from the storage tank 33, as well as being able to reduce or completely prevent the outflow of the application liquid to the exterior when the apparatus is tilted during movement, shipment, or the like.

Figure 15:
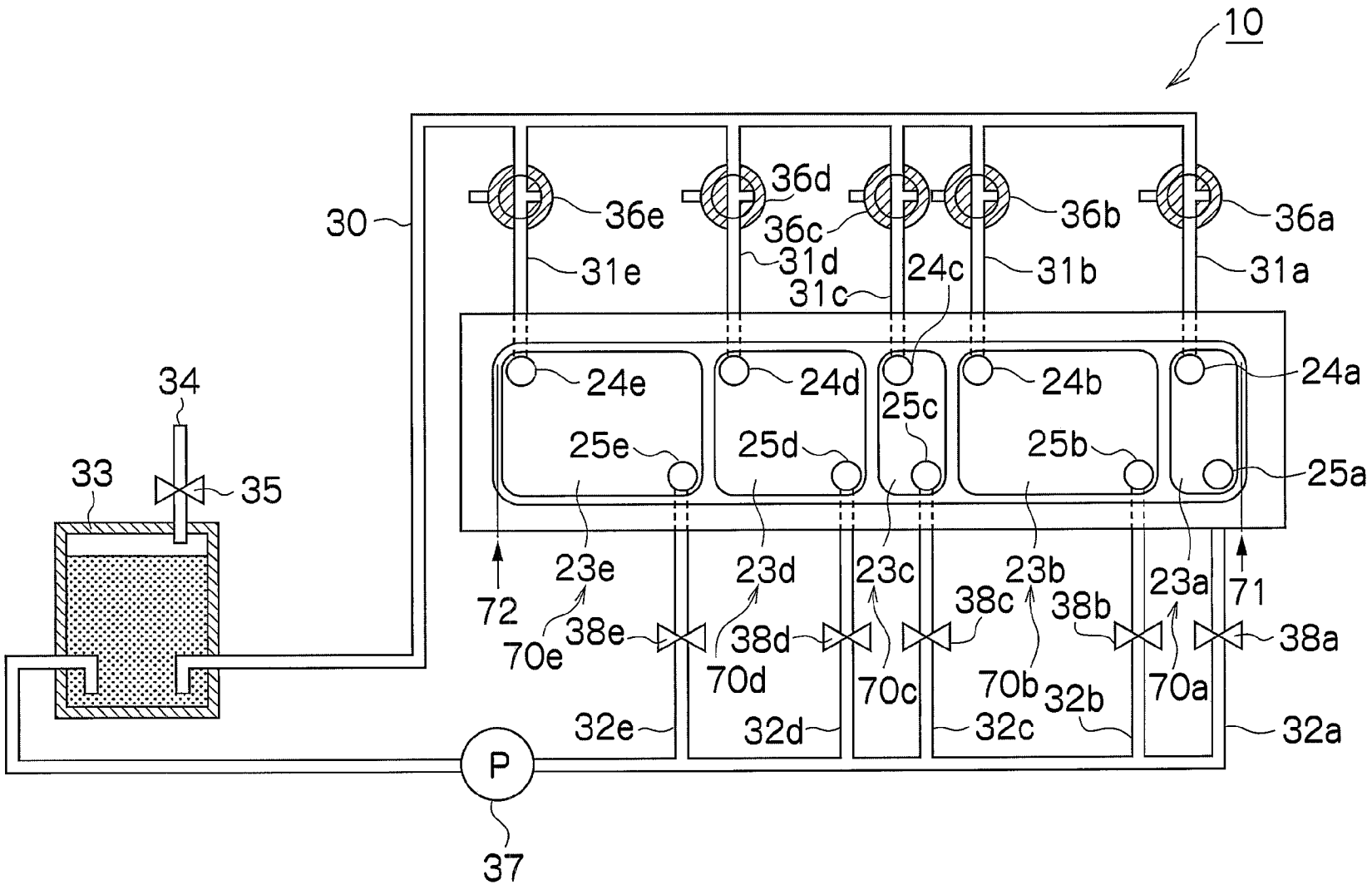
FIG. 15 is a schematic drawing showing a liquid supply system in a liquid application apparatus according to another embodiment of the present invention.

The liquid application apparatus 10 described with reference to FIG. 9 has the individual pumps 37*a* to 37*e* provided respectively for the recesses 23*a* to 23*e*; however, the present invention is not limited in particular to a case such as this. For example, it is also possible to provide a common pump 37 for the plurality of recesses 23*a* to 23*e* as shown in FIG. 15. In other words, the common pump 37 is provided for the plurality of liquid chambers 70*a* to 70*e*. In this embodiment, the flow rate is adjusted by means of flow rate adjusting valves 38*a* to 38*e*, which are provided respectively for the recesses 23*a* to 23*e*.

Image Forming Apparatus

Figure 16:
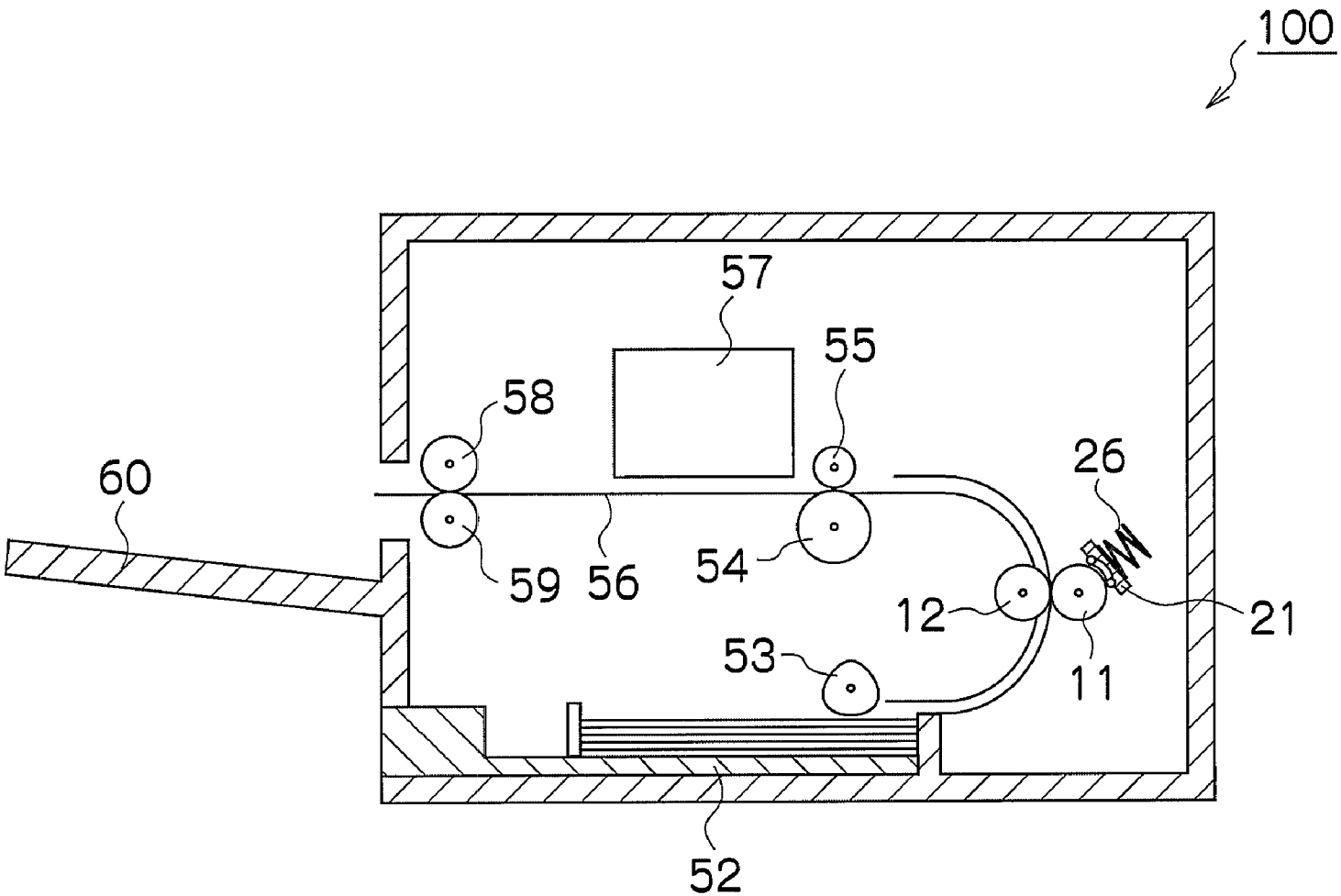
FIG. 16 is a schematic drawing of an image forming apparatus including a liquid application apparatus according to an embodiment of the present invention.

FIG. 16 is a schematic drawing of an image forming apparatus 100, which employs the liquid application apparatus 10 shown in FIG. 1 according to the embodiment of the present invention.

A plurality of media P (hereinafter, called "recording media") are loaded in a paper supply cassette 52. A feed roller 53 picks up the recording media P (application receiving media) loaded in the paper supply cassette 52, one sheet at a time, and conveys same to a conveyance path. The application roller 11, which applies treatment liquid to the recording medium P, and a back-up roller 12, which supports the recording medium P, are provided in the conveyance path. The recording medium P onto which the treatment liquid has been applied is conveyed onto a platen 56 by a pair of conveyance rollers 54 and 55. A head 57 forms an image by ejecting and depositing ink onto the recording medium P on the platen 56. The recording medium P on which the image has been formed is outputted to an output tray 60 by a pair of output rollers 58 and 59.

Figure 17:
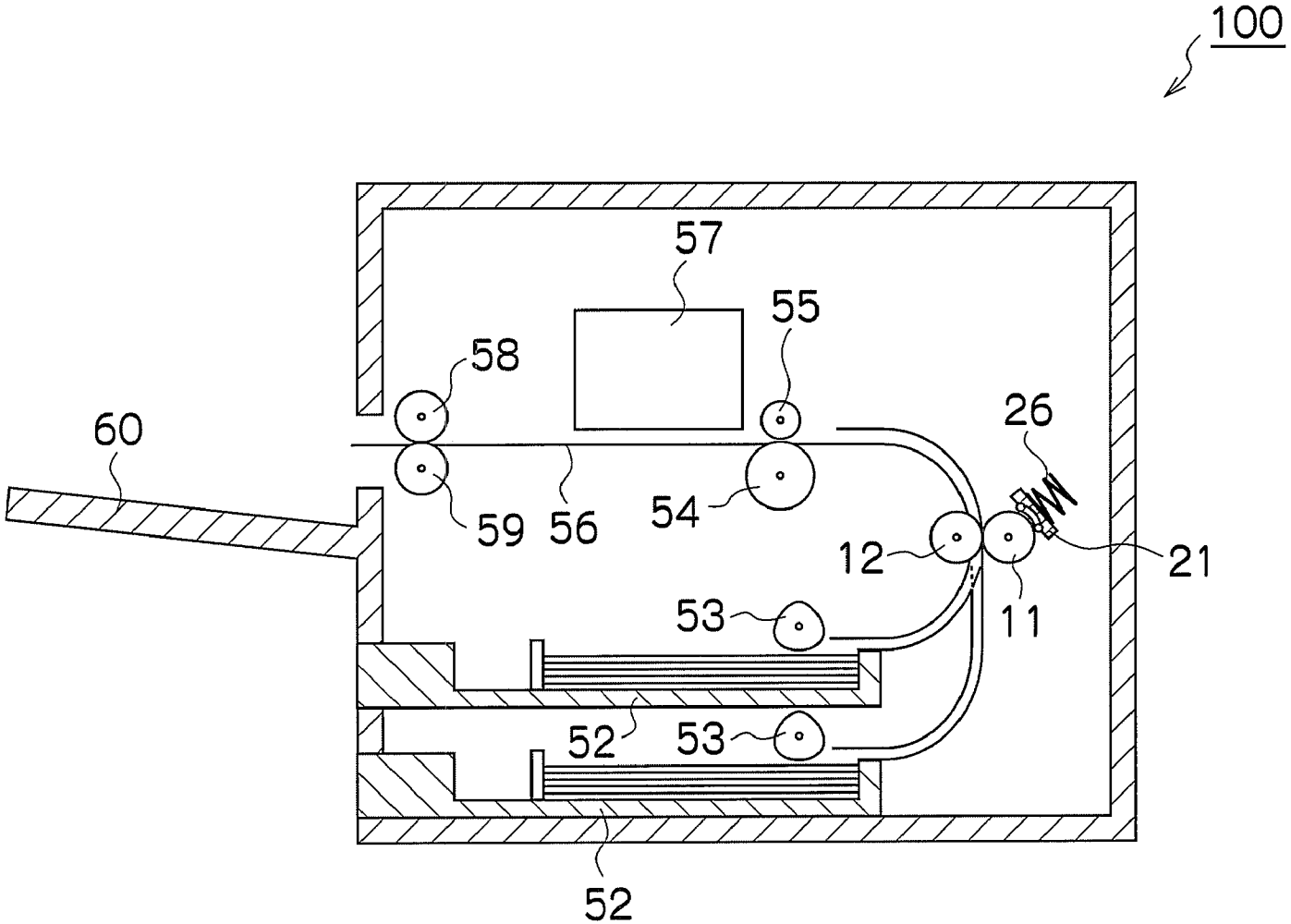
FIG. 17 is a schematic drawing of an image forming apparatus including a liquid application apparatus according to another embodiment of the present invention.

The paper supply cassette 52 is detachable with respect to the image forming apparatus 100, and is capable of being loaded with the recording media P of different widths. As shown in FIG. 17, it is also possible to provide a plurality of paper supply cassettes 52. It is possible to load recording media P of mutually different widths into the paper supply cassettes 52. It is also possible to provide a manual paper supply device.

As the image forming apparatus, it is also possible to use a so-called full-line type of image forming apparatus, which forms an image by using a long head having nozzles for ejecting ink arranged through the maximum width of the recording medium P.

The treatment liquid is a liquid that accelerates the aggregation of the coloring material when the ink containing the coloring material is deposited on the recording medium P, for example. By accelerating the aggregation of the coloring material on the recording medium P by means of the treatment liquid of this kind, it is possible to improve the recording density as well as reducing or preventing bleeding.

The liquid (application liquid) applied to the recording medium P in the image forming apparatus according to the embodiment of the present invention is not limited to being the treatment liquid as described above.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus which applies liquid to media of a plurality of types having different widths in a widthwise direction that is perpendicular to a direction of conveyance of the media, the apparatus comprising:

a liquid application member which has an application surface applying the liquid to the media;

a liquid holding member which has a plurality of recesses arranged in the widthwise direction, a plurality of liquid supply ports arranged respectively in the recesses, and a plurality of liquid discharge ports arranged respectively in the recesses, the liquid holding member forming a plurality of liquid chambers with the recesses by abutting against the application surface of the liquid application member;

a liquid chamber selection device which selects, of the plurality of liquid chambers, liquid chambers to be supplied with the liquid as liquid supply chambers, and liquid chambers not to be supplied with the liquid as liquid non-supply chambers, in accordance with size of the media in the widthwise direction, a liquid supply and discharge device which supplies the liquid to the liquid supply chambers through the liquid supply ports, and discharges the liquid from the liquid non-supply chambers through the liquid discharge ports, a medium size determination device which determines the widths of the media.

2. The liquid application apparatus as defined in claim 1, wherein the recesses of the liquid holding member are defined by partitions arranged according to differentials in the widths between the media with reference to a conveyance reference position which forms a reference in the widthwise direction when the media are conveyed to the liquid application member.

3. The liquid application apparatus as defined in claim 2, wherein the partitions are arranged according to the differentials in the widths between the media of at least one of A series sizes, B series sizes, an L size and a postcard size.

4. The liquid application apparatus as defined in claim 2, wherein the conveyance reference position includes a right-hand reference position and a left-hand reference position, and the partitions are arranged with reference to at least one of the right-hand reference position and the left-hand reference position.

5. The liquid application apparatus as defined in claim 4, wherein the partitions are arranged for A series sizes with reference to one of the right-hand reference position and the left-hand reference position, and for B series sizes with reference to the other of the right-hand reference position and the left-hand reference position.

6. The liquid application apparatus as defined in claim 1, wherein the liquid chamber selection device selects the liquid supply chambers and the liquid non-supply chambers from the plurality of liquid chambers, the liquid supply chambers and the liquid non-supply chambers being located respectively inside and outside the range of the one of the widths of the media with reference to a conveyance reference position which forms a reference in the widthwise direction when the media are conveyed to the liquid application member.

7. The liquid application apparatus as defined in claim 1, wherein the liquid holding member has an abutting portion which abuts against the liquid application member and is made of a low friction material which has a low frictional load with respect to the liquid application member.

8. The liquid application apparatus as defined in claim 7, wherein the low friction material is fluororesin.

9. The liquid application apparatus as defined in claim 7, wherein the low friction material is one of polytetrafluoroethylene and polyoxymethylene.

10. The liquid application apparatus as defined in claim 1, wherein an image is formed on the medium by applying a liquid containing coloring material to the medium onto which the liquid has been applied by the liquid application member.

* * * * *